United States Patent [19]

Hastings

[11] 4,269,089

[45] May 26, 1981

[54] ADJUSTABLE RATCHET PLIERS

[76] Inventor: Charles E. Hastings, 3404 Paris Pl., Orlando, Fla. 32808

[21] Appl. No.: 101,552

[22] Filed: Dec. 10, 1979

Related U.S. Application Data

[63] Continuation-in-part of Ser. No. 963,433, Nov. 24, 1978.

[51] Int. Cl.[3] ..... B25B 7/04

[52] U.S. Cl. ..... 81/410 R; 81/411

[58] Field of Search ..... 81/355, 357, 385, 393, 81/405, 407–414

[56] References Cited

U.S. PATENT DOCUMENTS

| | | | |
|---|---|---|---|
| 1,565,210 | 12/1925 | Seiber | 81/410 R |
| 2,361,607 | 10/1944 | Daniels | 81/410 R |
| 2,704,471 | 3/1955 | Hendrickson | 81/410 R |

FOREIGN PATENT DOCUMENTS

| | | | |
|---|---|---|---|
| 958459 | 2/1957 | Fed. Rep. of Germany | 81/411 |

*Primary Examiner*—James L. Jones, Jr.

*Attorney, Agent, or Firm*—Duckworth, Hobby, Allen, Dyer & Pettis

[57] ABSTRACT

A rapidly adjustable ratchet pliers having a first and second jaw member integral with a first and second handle member that pivotally cooperate to grasp a workpiece between the jaw members. The pliers also include a ratchet dog pivotally disposed in a slot of the first jaw member. The slot includes a surface defining tooth cavities and a smooth surface opposite thereof. The ratchet dog includes a biasing means that slidably and continuously contacts the smooth surface and a tooth normally biased into engagement with the tooth cavity surface.

An abutment projects from a surface of the second jaw member into the slot whereby outward pivotal movement of the second handle member causes the abutment to contact a shelf of the ratchet dog and thereby release the dog from its biased engagement with the tooth cavity surface of the slot. Thereafter, the first jaw member may be adjusted relative to the second jaw member. Rapid closing of the jaw members is easily accomplished by simply shifting the second jaw member in a direction parallel with the slot in the first jaw member whereby the ratchet dog tooth freely ratchets over the slot teeth to a preselected location.

5 Claims, 7 Drawing Figures

ADJUSTABLE RATCHET PLIERS

This is a continuation-in-part of application Ser. No. 963,433, filed Nov. 24, 1978.

BACKGROUND OF THE INVENTION

This invention relates to pliers tools and more specifically to a ratchet pliers having jaw members that may be easily and rapidly adjusted to accomodate different size workpieces.

Attempts have been made in the past to provide for rapid adjustment of pliers jaw members. One such example is U.S. Pat. No. 3,534,641 granted to Donald Le Duc on Oct. 20, 1970. This patent teaches an adjustable pliers tool having a pair of pivotal crossed handle members and a slidable jaw member. One handle includes a fixed jaw which cooperates with the slidable jaw member. A toothed pawl is disposed about the pivot and projects into a slot in one handle member for engaging a plurality of slot teeth disposed therein. The pawl is biased into engagement with the slot teeth by a spring supported on the pivot. In operation, the pliers are adjusted over a workpiece and pressure applied on the handles to cause a camming surface on one handle to cam against the edge of the slidable jaw and force it up against the workpiece.

Prior U.S. Pat. Nos. 2,704,471; 2,361,607; and 1,565,210 each show adjustable pliers having locking members working in conjunction with tracks.

To reopen the jaws, the handles are pivoted outward thereby overcoming the spring biasing force to retract the pawl from its engagement with the slot teeth, whereby the jaws are adjusted relative to one another. Adjustment of the jaws can only be accomplished by opening the handles relative to one another.

The applicant's device is an improvement over this concept, in that the pliers may be rapidly closed upon a workpiece while the handles are in the closed mode.

SUMMARY OF THE INVENTION

This invention provides an adjustable ratchet pliers having a pair of jaw members that may be easily adjusted to a selected open or closed mode or rapidly adjusted to a closed mode. The jaw members are integral with a pair of pivotally coupled handle members.

The first jaw member includes a slot defining a surface having tooth cavities and an opposed surface. Freely rotatable on the pivot and within the slot is a ratchet dog that includes a tooth, biasing means, and a release shelf. The ratchet dog tooth is normally biased into engagement with the toothed cavities of the slot. An abutment projects from the surface of the second jaw member into the slot and in the path of the ratchet dog shelf but normally free of contact therewith. To rapidly engage a workpiece, the handles need only be maintained in a closed relationship to one another. The second handle is shifted upward and parallel to the slot in the first handle wherein the second jaw member closes toward the first jaw member. To allow this to occur, the ratchet dog, which until this time is biased into full engagement with the teeth cavities of the slot, is urged to pivot out of engagement and thereafter to ratchet along the crest of the teeth. When the jaw members close in and contact the workpiece, the second handle can no longer be shifted and the ratchet dog engages the nearest cavity in the slot.

Thereafter, the plier handles are compressed and the jaw members tightly grip the workpiece. The jaw members are easily released from the workpiece by pivoting the handle members outward from one another. As the jaw members pivot, the abutment on the second jaw member is rapidly displaced to contact the ratchet dog shelf and urge the ratchet dog out of engagement with the slot cavity. At this time, the jaw members may be easily adjusted. When the handle members are pivoted toward one another, the abutment is radially displaced free of the ratchet dog whereby the ratchet dog is free to re-engage the slot cavity.

Accordingly, it is an object of this invention to provide an adjustable pliers whereby the jaw members can be rapidly closed upon a workpiece.

Another object of this invention is to provide an adjustable pliers whereby the jaw members can be rapidly closed upon a workpiece without displacing the pliers handles relative to one another.

A further object of this invention is to provide an adjustable pliers that can be adjusted without jamming.

A still further object of this invention is to provide an adjustable pliers whereby the jaw members do not have to be parallel to each other in order to grip the workpiece.

A still further object of the present invention is to provide an adjustable pliers whereby the pliers handles need only be pivoted apart a minimum distance to release the jaw members.

Other objects, features and advantages of the present invention will become more apparent from the following description, including appended claims, and accompanying drawing, in which:

DESCRIPTION OF THE PREFERRED EMBODIMENT

Figure 1:
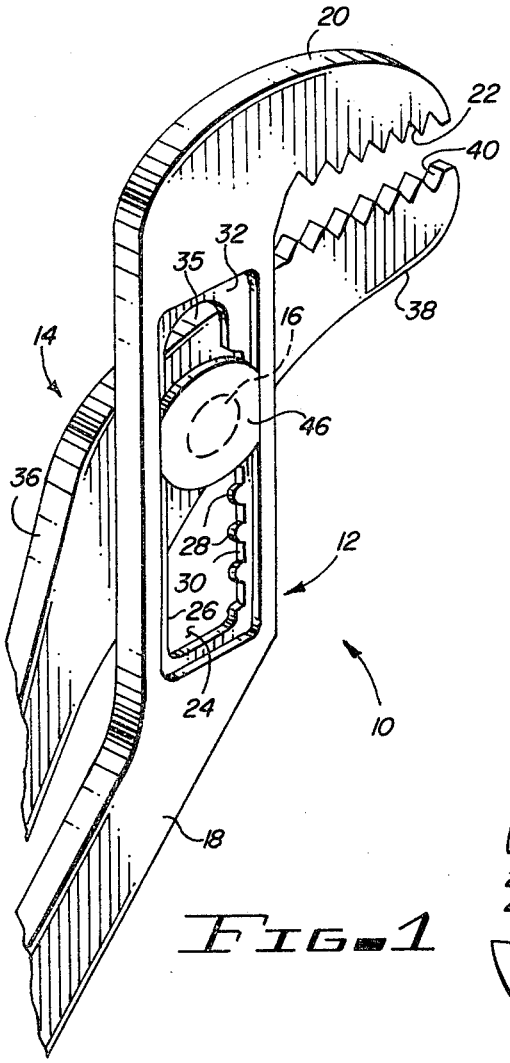
FIG. 1 is a perspective view of the improved pliers tool in accordance with the invention.
Figure 2:
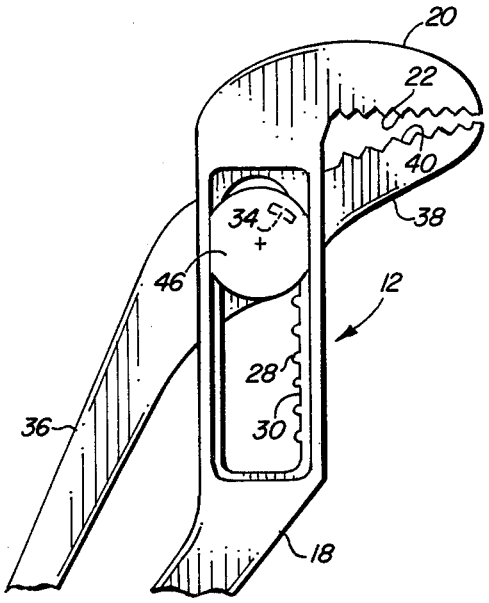
FIG. 2 is an elevation view of the improved pliers tool of FIG. 1.

Referring to the drawing, and to FIGS. 1 and 2 in particular, there is generally designated by the reference character 10 a pliers embodiment constructed in accordance with the invention. The pliers 10 includes a first jaw member 12 and a second jaw member 14 that are pivotally connected by a pivot pin 16.

Jaw member 12 includes an elongated handle portion 18 and a jaw head portion 20. Jaw head portion 20 has an engaging surface 22 disposed thereon and includes an elongated slot 24.

A surface 26 of slot 24 is smooth while the opposite surface 28 thereof is formed with a plurality of cavities 30. A shallow recess 32 circumvents the periphery of slot 24.

Jaw member 14 includes a fixed abutment 34, a handle portion 36 and a jaw head portion 38. Jaw head portion 38 has an engaging surface 40 disposed thereon that is in alignment with and opposed to engaging surface 22 of jaw head portion 20. As illustrated, engaging surfaces 22 and 40 are serrated, but it will, of course, be understood that they may be smooth surfaces, if desired. In either event, surfaces 22 and 40 are generally disposed in a substantially parallel spaced relationship.

Abutment 34 is radially disposed from pivot pin 16 and projects from a surface of jaw member 14 into slot 24. Abutment 34 is further disposed normally free of a cooperating ratchet dog 42.

Pin 16 includes a shaft portion 44 that has an enlarged head portion 46 at one end and a threaded portion 48 at the opposite end thereof.

Head portion 46 is defined by a thin silhouette and a diameter that is slidable within recess 32. The length of shaft portion 44 is greater than the combined thicknesses of first jaw member 12 and second jaw member 14 to allow for unrestricted pivotal movement therebetween.

The jaw members are confined in a pivotal relationship by a lock nut 50 on the threaded portion 48. A spring washer 52 imparts a controlled friction between the jaw members during operation.

As illustrated in FIGS. 3–6, ratchet dog 42 is pivotally supported about pin 16 and includes a tooth 54 that functionally engages a selected cavity 30 of slot surface 28.

Disposed in a step portion 58 of ratchet dog 42 is a receptacle 59. Confined in receptacle 59 is a spring 60 and a ratchet pin 62. Spring 60 is always partially compressed by one end of ratchet pin 62 while the opposite end thereof is in continual sliding contact with slot surface 26. The combined effect of spring 60, ratchet pin 62 and surface 28 is to bias ratchet dog tooth 54 into engagement with surface 26. Proximate tooth 54 and in the rotational path of abutment 34 is a release shelf 64.

Figure 6:
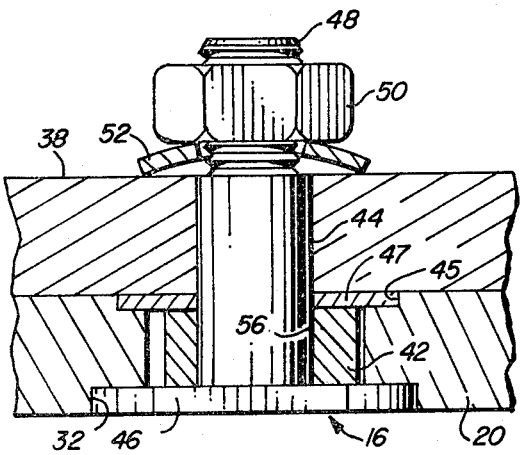
FIG. 6 is a sectional view showing the ratchet dog, ratchet pin and related components.

The position of pin 16, which is attached to ratchet dog 42 through opening 56, relative to tooth 54 is such that a force at pin 16 directed parallel to slot 24 and away from the jaw members will induce tooth 54 to increasingly engage tooth cavity 30. Conversely, a force directed parallel to slot 24 and toward the jaw members will induce tooth 54 to dis-engage from tooth cavity 30. In FIG. 6, a raised annular ledge 47 on jaw portion 38 fits into a sunken annular portion 45 in jaw head portion 20 to provide greater support between the jaws.

Figure 3:
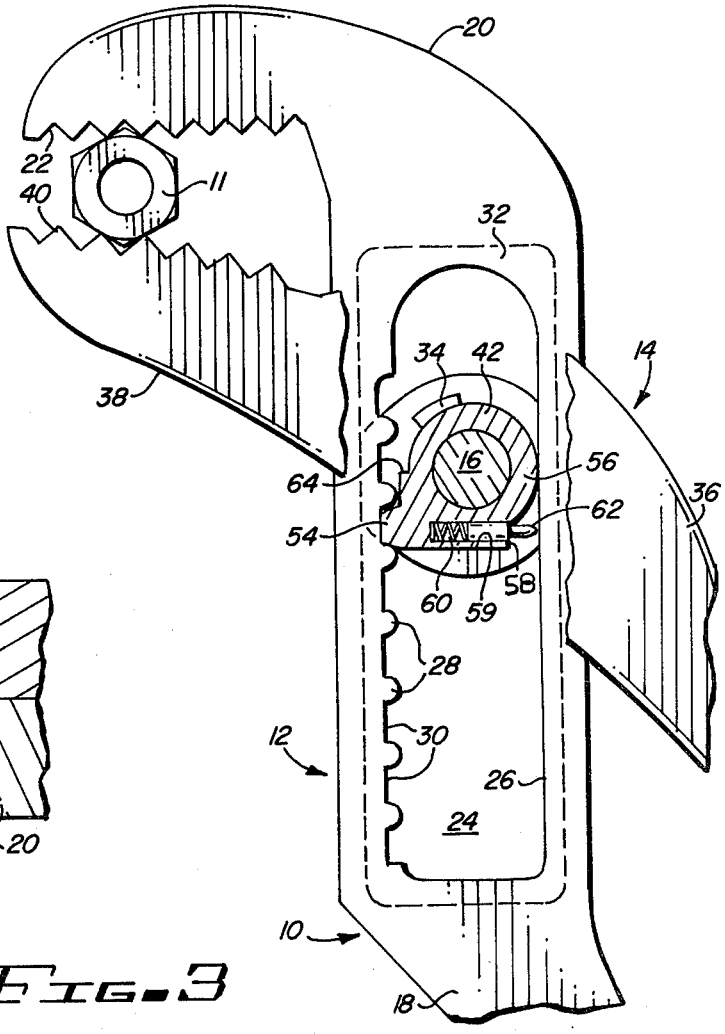
FIG. 3 is a fragmentary elevation view of a portion of the tool of FIG. 1, illustrating the construction of the slot and ratchet dog in its engaged mode.
Figure 5:
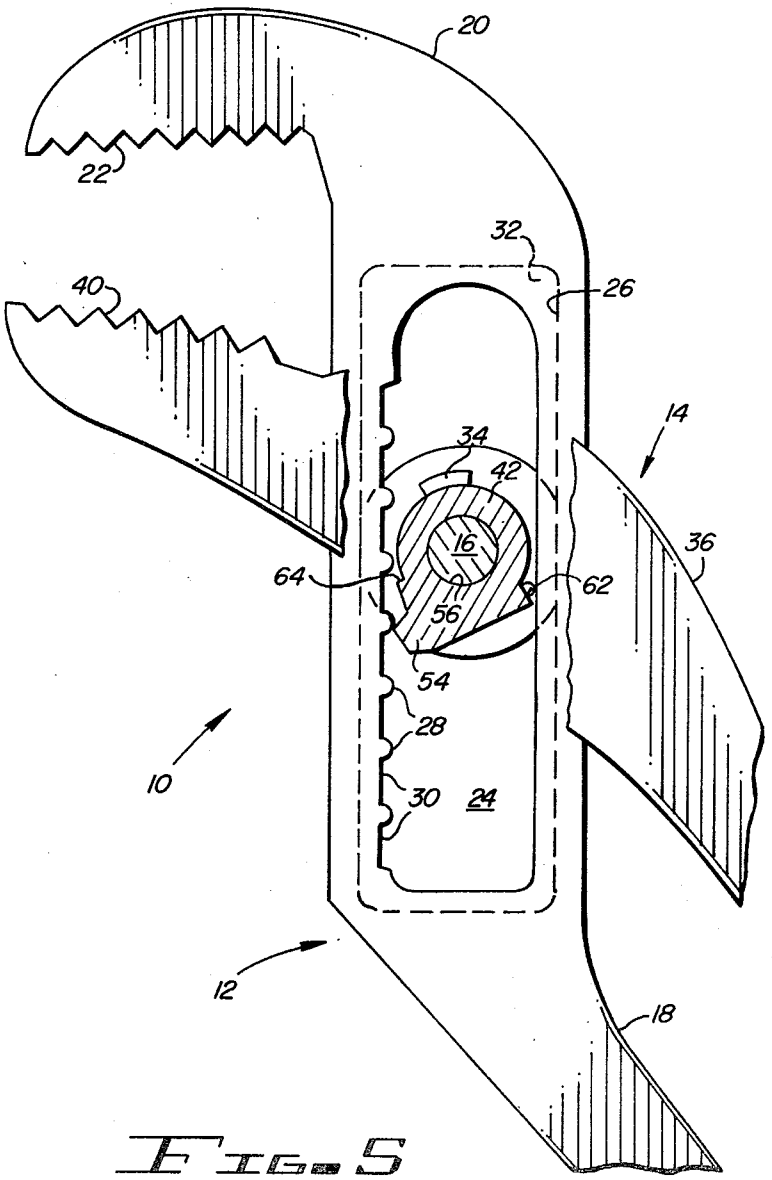
FIG. 5 is a fragmentary elevation of the invention showing the pliers in a rapid closing mode.
Figure 4:
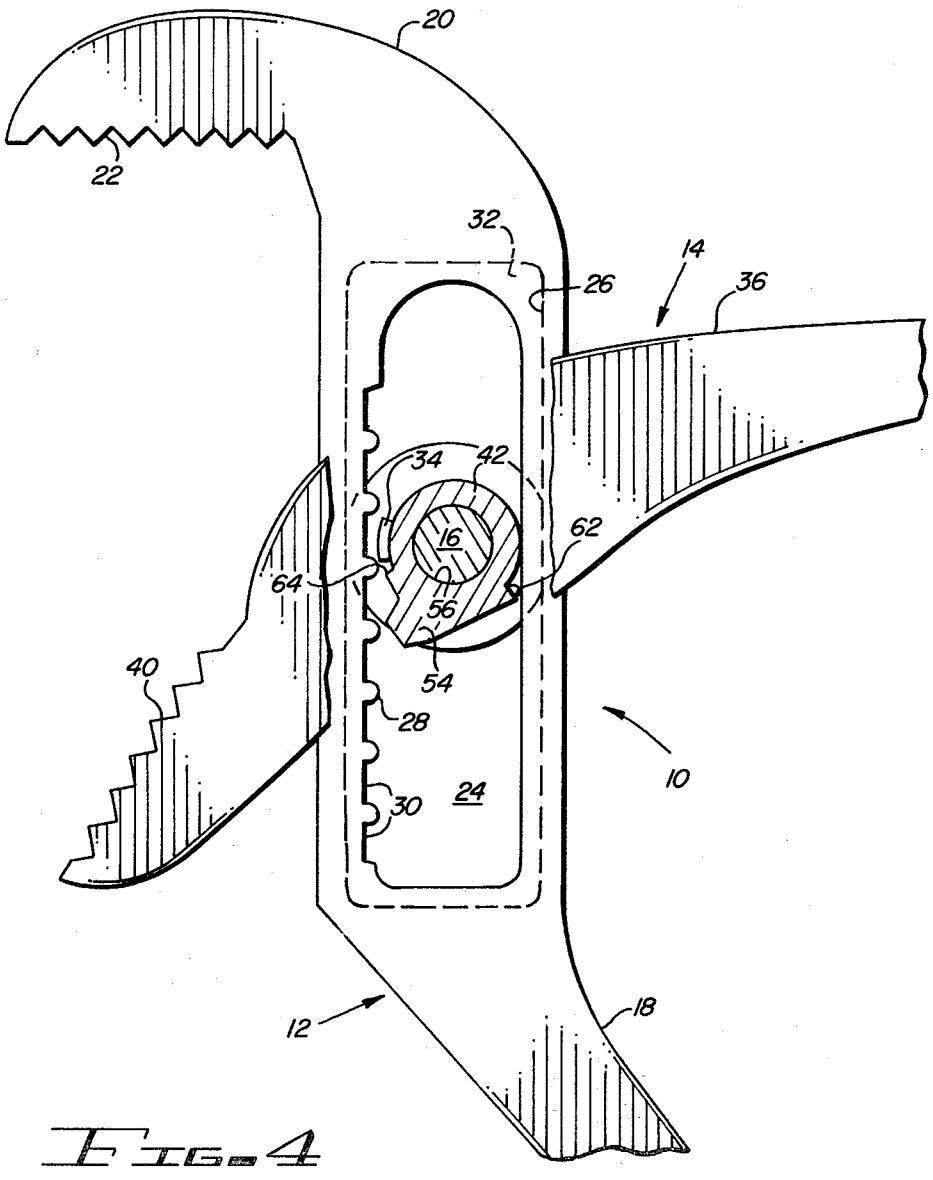
FIG. 4 is a fragmentary elevation view of a portion of the tool of FIG. 1, illustrating the construction of the slot and ratchet dog in its dis-engaged mode.

The operation of pliers 10 is illustrated in FIGS. 3–5. Specifically, FIG. 3 shows a workpiece 11 fully engaged by jaw members 20 and 38. At this time, tooth 54 of ratchet dog 42 is fully engaged in cavity 30. The engagement of ratchet dog tooth 54 and cavity 30 is directly proportional to the closing pressure applied to handles 18 and 36. Where it is desired to re-adjust one jaw member relative to the other to accomodate a different size workpiece, ratchet dog 42 is released from its engagement with tooth cavity 30. This is accomplished, as shown in FIG. 4, by pivoting handles 36 away from handle 18 until abutment 34 (shown in section) engages release shelf 64 of ratchet dog 42. As the handles are further pivoted away from one another, abutment 34, in contact with shelf 64, urges ratchet dog 42 to pivot counter-clockwise. The biasing effect of ratchet pin 62 is overcome and tooth 54 is dis-engaged from tooth cavity 30 whereupon jaw member 20 may be re-adjusted relative to jaw member 38. When the handle members 18 and 36 are pivoted toward one another, abutment 34 is radially displaced from its contact with ratchet dog shelf 64.

This clockwise movement of abutment 34 allows ratchet pin 62 to again impart a biasing force on ratchet dog 42 which is urged to pivot clockwise until tooth 54 re-engages tooth cavity 30.

The jaw members are speedily closed, as shown in FIG. 5, by merely shifting jaw member 38 in a direction parallel to slot 24 and toward jaw member 20. Ratchet dog 42 will pivot out of engagement with tooth cavity 30 whereupon the jaws may be closed to a selected position. When the selected position is reached, ratchet dog 42 is biased into re-engagement with tooth cavity 30.

Figure 7:
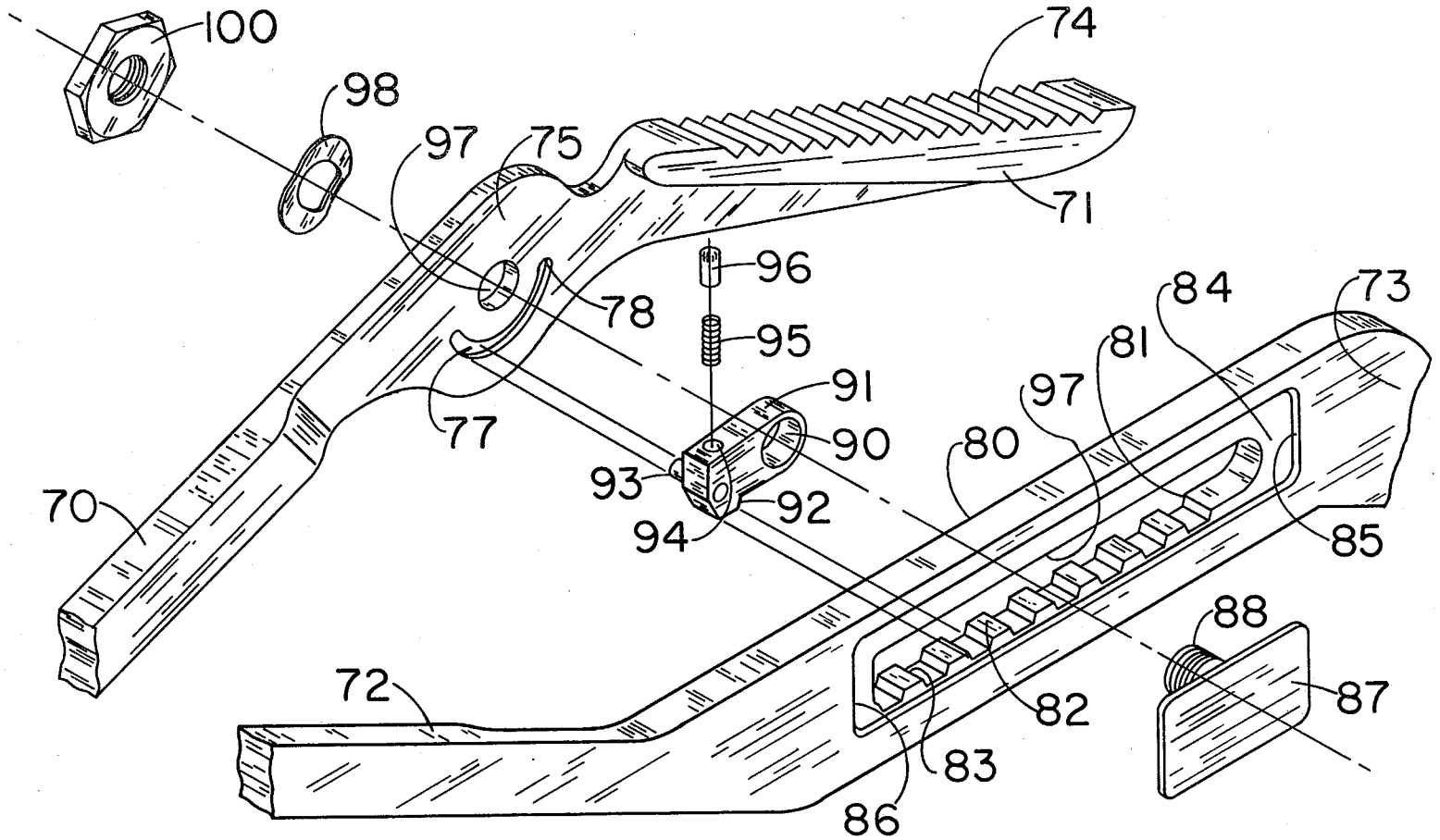
FIG. 7 is an exploded view of a second embodiment of the pliers in accordance with this invention.

Referring now to FIG. 7, a second embodiment of the present invention is illustrated having a first handle 70, having a jaw 71 on one end portion thereof, and a second handle 72 having a jaw portion 73. Jaw 71 has a serrated jaw surface 74 and has a connecting portion 75 for connecting the handles together. An aperture 76 extends through the connecting portion 75 which has an arcuate release channel 77 located in one side thereof having a stop 78 at one end of the channel 77. Handle 72 has an elongated connecting portion 80 for connecting with the connecting portion 75 attached to handle 70. The connecting portion 80 has an elongated slot 81 having a gear rack 82 on one side thereof having a plurality of notched gear teeth 83. On one side of the connecting portion 80 is a recessed sliding track 84 having a stop 85 on one end and a stop 86 on the other end thereof. The handles 70 and 72 are connected by a slide 87 having a threaded shaft 88 on one side thereof. The slide 87 slides in the slide track 84 but is stopped at either end of the slide track 84 by the stops 85 or 86. The threaded shaft 88 is connected through a shaft opening 90 in a locking pawl 91 which rides in the elongated opening 81 of the assembled pliers. Pawl 91 has a ratchet pawl 92 and a protruding release pin 93 protruding out one side thereof. The pawl also has a bore 94 having a spring 95 therein and a pin 96 sliding in the opening 94 on top of the spring 95, thereby providing a spring biased pin biased against a surface 97 opposite the notched gear rack 82 of the elongated opening 81. The pin 93 rides in the channel 77 in the assembled pliers and will ride until it reaches the stop 78 so that by opening the pliers until the release pin 93 engages the stop 78 the pawl 91 is released from the gear rack 82 to allow the pliers to be slid in the opposite direction for opening the jaws of the pliers.

When closing the jaws onto a nut, the handles can be slid, closing the jaws without the jaws being opened since the pawl tooth 92 is spring loaded and will slide in the gears 83 on the rack 82. The threaded shaft 88 passes through an aperture 97 in the connecting portion 75 of the handle 70 and through a wave washer 98 and has a nut 100 threaded thereonto.

As can be seen from this and the other drawings, the adjustable pliers of the present invention, advantageously, allow the jaws to be slid onto a nut without opening the pliers for making special adjustments, which jaws are locked in the proper position onto the nut. For retracting the jaws, the handles need only be opened to a position where the pin 93 engages the stop 78 releasing the pawl 91 and pawl tooth 92 to slide the jaws apart. This simplified version of an adjustable pliers mechanism not only is easy and fast to use, but is easily manufactured with a minimum of components and a versatile adjustable pliers mechanism.

While the foregoing description has shown and described the fundamental novel features as applied to the preferred embodiments, it will be understood by those skilled in the art that modification embodied in various forms may be made without departing from the spirit and scope of the invention.

I claim:

1. An adjustable ratchet pliers comprising in combination:

a first jaw member including a handle and a jaw portion, said first jaw member having an elongated slot formed therein and a plurality of notched positions formed in said elongated slot;

a second jaw member including a handle and a jaw portion, said second jaw member being pivotally coupled to said first jaw member;

slide track means formed along said elongated slot in said first jaw member, said slide track means including a sunken area on at least two sides of said elongated slot in said first jaw member;

slide means for sliding said second jaw member relative to said first jaw member, said slide means having a shaft and a sliding member, said shaft being connected to said second jaw member and extended through said elongated slot in said first jaw means, said slide member being attached to said shaft and slidably positioned on said slide track, and said slide means sliding member being a flat member sliding in said slide track means sunken area adjacent said elongated slot in said first jaw member;

locking means pivotally mounted on said slide means shaft and extending into said elongated slot for engaging said notched positions therein, said locking means biasing means including a spring biased pin mounted in a bore in said locking means biasing said pin against the opposite side of said first jaw member elongated slot from said plurality of notched positions;

releasing means for rapidly releasing said locking means from a notched position,, said releasing means including a stop on said second jaw member for engaging a portion of said locking means when said first and second jaw members are rotated relative to each other to engage said stop on said second jaw with said portion of said locking means whereby said adjustable pliers can be locked into an adjusted position and rapidly released for changing positions.

2. An adjustable ratchet pliers in accordance with claim 1, in which said releasing means for rapidly releasing said locking means from a notched position includes an arcuate groove in said second jaw member, said grooved end forming a stop for engaging a portion of said locking means.

3. An adjustable ratchet pliers in accordance with claim 2, in which said locking means portion for engaging said stop on said second jaw member is a protruding pin.

4. An adjustable ratchet pliers in accordance with claim 3, in which said locking means includes a pawl for engaging said notched position in said elongated slot and biasing means for biasing said locking means pawl toward said notched positions.

5. An adjustable ratchet pliers in accordance with claim 4, in which said slide means shaft is threaded on one end and extends through an aperture in said second jaw member and has a nut threaded thereon.

* * * * *